United States Patent [19]

Van der Wal

[11] 4,092,944

[45] June 6, 1978

[54] UNDERWATER ANCHOR FOR THE MOORING OF FLOATING STRUCTURES AS WELL AS A METHOD FOR THE PLACING OF SUCH AN ANCHOR

[75] Inventor: Siemen Van der Wal, Lunteren, Netherlands

[73] Assignee: Verenigde Bedrijven Bredero N.V., Utrecht, Netherlands

[21] Appl. No.: 688,486

[22] Filed: May 20, 1976

[30] Foreign Application Priority Data

May 29, 1975 Netherlands ..... 7506376

[51] Int. Cl.[2] ..... B63B 21/24

[52] U.S. Cl. ..... 114/297

[58] Field of Search ..... 114/0.5 D, 0.5 T, 206 R, 114/294, 297, 298, 299, 301, 303, 304–310, 264, 265, 44, 49, 50, 51–55; 61/94, 98, 99, 100; 175/8

[56] References Cited

U.S. PATENT DOCUMENTS

| | | | |
|---|---|---|---|
| 2,973,046 | 12/1961 | McLean et al. | 175/8 |
| 3,118,416 | 1/1964 | Sawyer | 114/297 |
| 3,496,900 | 2/1970 | Mott et al. | 114/296 |
| 3,577,946 | 5/1971 | Horton | 114/265 |
| 3,780,685 | 12/1973 | Horton | 114/0.5 D |
| 3,922,868 | 12/1975 | McDonald et al. | 114/0.5 D |

*Primary Examiner*—Trygve M. Blix
*Assistant Examiner*—Jesus D. Sotelo
*Attorney, Agent, or Firm*—Brumbaugh, Graves, Donohue & Raymond

[57] ABSTRACT

An underwater anchor for keeping floating structures in position in oceans or other waters has at least one oblong cylindrical hollow body constructed in such a manner that it can withstand the external water pressure at the depth at which it is used. The body has a positive floating power when its interior is almost entirely filled with air. One or more fastening points for anchor cables are located on the body and it may have one or more connections for adding ballast to the interior of the body.

5 Claims, 6 Drawing Figures

UNDERWATER ANCHOR FOR THE MOORING OF FLOATING STRUCTURES AS WELL AS A METHOD FOR THE PLACING OF SUCH AN ANCHOR

BACKGROUND OF THE INVENTION

The invention relates to an underwater anchor for keeping floating structures in position in oceans or other waters.

For the keeping in position of floating structures such as drilling platforms, floating aerodromes and the like, extremely high forces may be required due to the action of wind, waves and currents upon the floating structure.

The bottom of an ocean, a river, a lake or the like may consist of very stiff layers but also of very soft layers with all possible variations in between.

SUMMARY OF THE INVENTION

The invention aims at providing an anchor capable of producing extremely high anchoring forces, up to several hundreds of tons, regardless of the nature of the bottom of the ocean, river, lake or the like, and which, nevertheless, will present no particular difficulties when conveyed horizontally or vertically.

According to the invention, this object is achieved with an anchor comprising of at least one oblong, and preferably cylindrical, hollow body with closed ends, which body is constructed in such a manner that it can withstand the external water pressure at the depth where it is used, and it has a positive floating power when the interior of the body is entirely or almost entirely filled with air. The body is supplied with one or more fastening points for anchor cables or chains and for towing and/or lifting cables or chains, as well as with one or more connections for the ballasting of the interior of the body with water, sand, gravel, fluid concrete and the like.

In this manner, the anchor may be conveyed afloat and then sunk to the bottom of an ocean, river, lake or the like.

The body, or each body, is preferably subdivided into compartments by one or more entirely or partly closed transverse partition walls.

In this manner it will be possible to tilt the anchor as a result of the ballasting of one or more compartments.

Furthermore, the invention relates to a method for placing an anchor into the bottom of an ocean, river, lake or the like, characterised in that one end of the body, or each body subdivided into compartments, is fastened to the lifting cable of a floating lifting device. So much water is supplied to a compartment of the body or each body, which compartment is spaced from said lifting device, that the anchor will assume an upright position and the floating power of the anchor will become negative, but not exceeding the required maximum lifting power of the lifting device. The lifting cable is eased off until the point of the anchor reaches the bottom of the ocean, river, lake or the like and then partly sinks therein. While sinking, the anchor is ballasted until the required anchor weight is obtained.

Also, it is possible to slightly modify the method so that it is characterized in that (A) one end of the body or each body is fastened to the lifting cable of a floating lifting device; (B) that this end is lifted with respect to the other end; (C) that so much water is supplied to the body or each body that the anchor will assume an upright position and the floating power of the anchor becomes negative, but not exceeding the required maximum lifting power of the lifting device; (D) that the lifting cable is eased off until the point of the anchor reaches the bottom of the ocean, river, lake and the like and then partly sinks therein; and (E) that, while sinking, the anchor is ballasted until the required anchor weight is obtained.

Consequently, with these methods, the anchor is first tilted and then driven into the bottom in an upright position. These methods are applied when a thick soft layer, such as mud, is present on the bottom.

If the soil examination should prove that the bottom consists of stiff layers, such as sand and rock, or that the bottom is covered with a soft layer having relatively little depth, another method is applied, which method is characterized in that a lifting cable of a floating lifting device is fastened to both ends of the anchor; that so much water is supplied to the anchor that the floating power of the anchor becomes negative, but not exceeding the required maximum lifting power of the lifting device; and that the lifting cables are eased off until the anchor is lying on the bottom of the ocean, river, lake or the like, whereupon the body or each body is further ballasted until the required anchor weight is obtained.

For the placing of the anchor on or into the bottom, a floating lifting device will be required which, however, need have only a slight capacity.

BRIEF DESCRIPTION OF THE DRAWINGS

Various embodiments of the invention will now be further described with the aid of the drawings, wherein.

DESCRIPTION OF EXEMPLARY EMBODIMENTS

Figure 1:
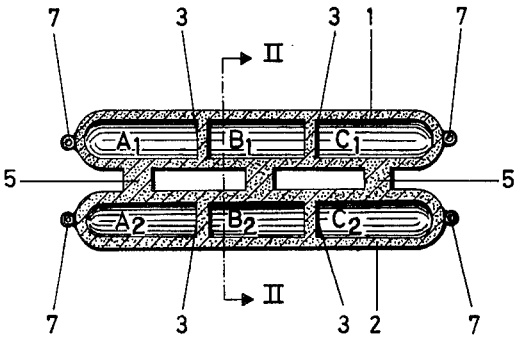
FIG. 1 shows a longitudinal section of an anchor comprised of two bodies, floating on the water surface.

The anchor shown in the drawings is comprised of two closed bodies 1 and 2 which are fastened to each other in two or more places. These bodies are preferably cylindrical but may also be of a different shape provided the requirement is fulfilled that it can withstand the external water pressure at the depth at which it is used.

The bodies 1 and 2 are manufactured from prestressed concrete, reinforced or not, or from other material of sufficient strength and weight.

Each body is subdivided into three compartments by entirely or partly closed partition walls 3. These compartments are marked with A1, B1 and C1 for body 1 and with A2, B2 and C2 for body 2.

Figure 2:
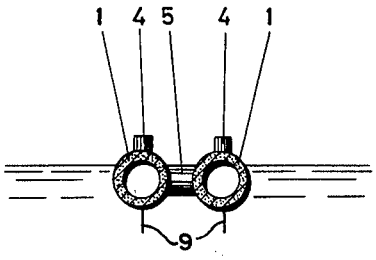
FIG. 2 shows a cross section of the anchor according to the line II—II of FIG. 1.

The anchor's own weight is about 90% of the weight of the water displaced when it is entirely submerged, so that the anchor may be towed afloat to the working area. The two bodies are afloat side by side so that a stable vessel is realized (FIG. 2).

All compartments or a certain number of them are supplied with means 4 to fill them with water at the desired moment or with any other material suitable for ballast, such as sand, gravel, fluid concrete, etc.

One of the connecting constructions 5 of the bodies 1 and 2 of the anchor may be utilized to fasten an anchor cable or anchor chain 6 to the anchor.

Moreover, at the exterior of the anchor, means 7 are provided in order to moor, to tow, etc. the floating anchor as well as to control the anchor while sinking by means of a non-shown floating lifting device and other vessels.

Figure 3:
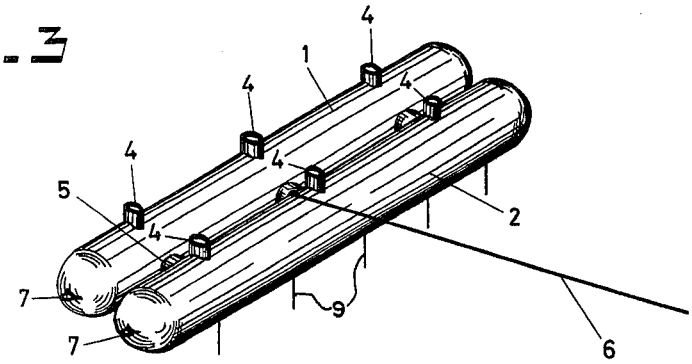
FIG. 3 gives a view in perspective of the anchor according to FIGS. 1 and 2, lying on the bottom of an ocean, river, lake.

The anchor may be applied in two different manners:

(a) If a soil examination should prove that the bottom consists of stiff layers, such as sand and rock, or that the bottom is covered with a soft layer having relatively little depth, such as mud, the anchor is placed flatly upon the bottom of the ocean (FIG. 3).

Figure 4:
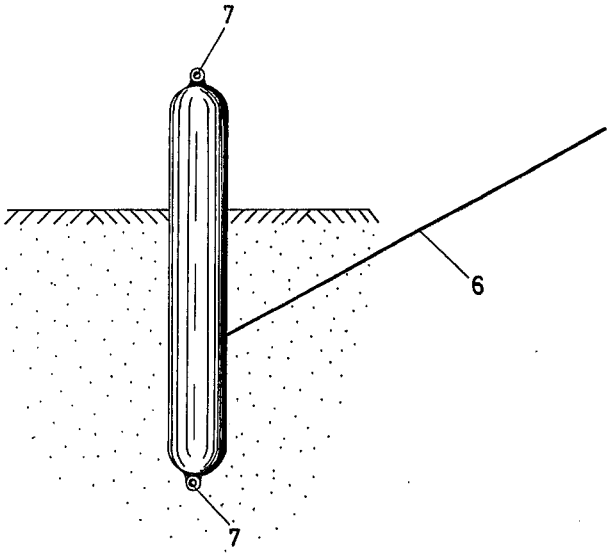
FIG. 4 gives a view of an anchor in upright position in the bottom of an ocean, river or lake.
Figure 5:
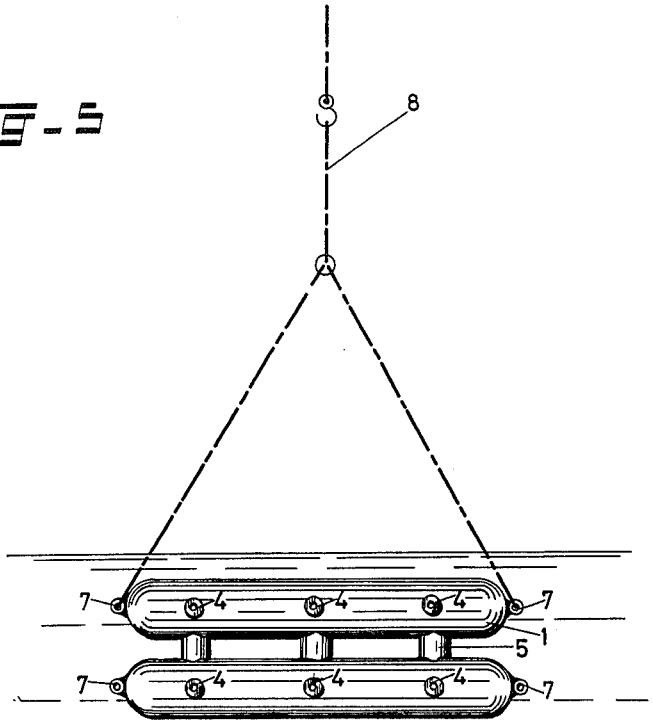
FIG. 5 shows the sinking of an anchor according to the invention for the purpose of assuming the position according to FIG. 3.

(b) If a soil examination should prove that a thick soft layer, such as mud, is present, the anchor is sunk into this layer perpendicularly, i.e. with the center line upright (FIG. 4). The determination of the distance from the lower end of the anchor to the fastening point of the anchor cable is dependent on the dimensions and weight of the anchor and on the mechanical properties of the soil on the bottom. Since the fastening point will disappear deep down into the bottom, it will be necessary to fasten the anchor cable 6 beforehand to one of the connecting constructions 5 or to another point. The sinking of the anchor takes place as follows:

(a) For a final position as in FIG. 3, see FIG. 5.

a.1. Both ends of body 1 of the floating anchor are connected with the lifting cables 8 of a floating crane.

a.2. By means of the floating crane, the cables 8 are stressed.

a.3. Water is allowed to flow into body 2, for instance into compartment B2, until the floating power of the anchor becomes negative. When the maximum lifting power of the crane amounts to for instance 25 tons, the negative floating power should remain under this value. Body 2 is now below body 1.

a.4. From the floating crane, the anchor is paid out until body 2 reaches the bottom of the ocean.

a.5. The compartment B2 is entirely filled with water.

a.6. The floating crane is shifted in a direction away from the structure to be moored so that the lifting cables 8 will make an angle with the vertical and body 1 will no longer be perpendicularly above body 2.

a.7. Water is allowed to flow into compartment B1, as a result of which the tilting motion of the anchor is intensified while the lifting cables are further eased off.

a.8. The anchor is lying as shown in FIG. 3, so that the connection with the crane may be disconnected, after which the bodies 1 and 2 are entirely filled with water and/or other ballasting material until the required anchor weight is obtained. By the action mentioned at sub a.6 the anchor cable 6 is made to lie across body 2.

Figure 6:
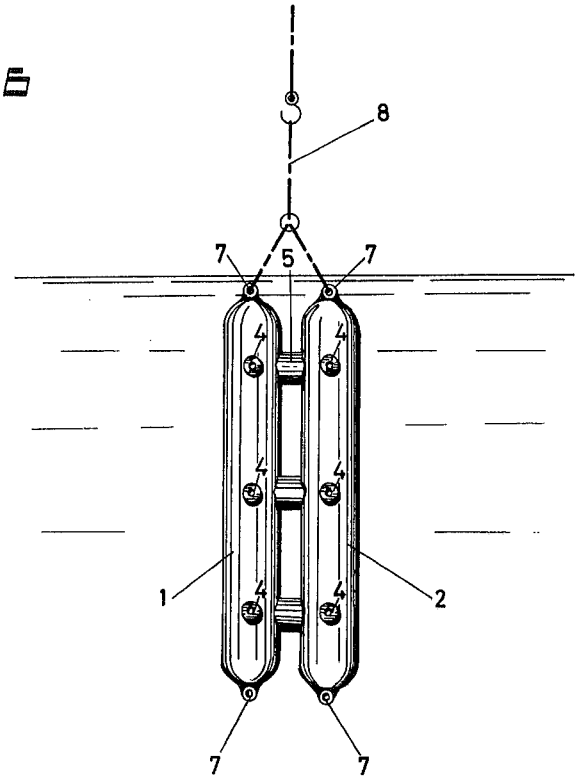
FIG. 6 shows the sinking of the anchor according to the invention for the purpose of assuming the position according to FIG. 4.

(b) For a final position as in FIG. 4, see FIG. 6.

b.1. An end of each of the bodies 1 and 2 of the floating anchor is connected with the hook of a floating crane by means of lifting cables 8 of equal length.

b.2. By means of the crane, the lifting cables 8 are stressed.

b.3. Into compartments A1 and A2 about equal quantities of water are allowed to flow, as a result of which the anchor will assume an upright position and the floating power of the anchor will become negative. When, for instance, the maximum lifting power of the crane amounts to 25 tons, the negative floating power should remain under that value. If an equal quantity of water is allowed to flow into the compartments A1 and A2, the anchor will be suspended in a precisely vertical position.

b.4. From the floating crane the anchor is paid out until it touches the soft layer on the bottom and then sinks therein.

b.5. Simultaneously with a slow easing off of the lifting cables 8 so as to prevent the crane from becoming overloaded, the compartments A1 and A2 are filled entirely, then B1 and B2 and, finally C1 and C2. Due to the increasing weight and the anchor's centre of gravity, which centre is low at first, the anchor will sink perpendicularly into the soft layer. When the bodies 1 and 2 do not possess partition walls 3, it is possible to raise one end of the anchor somewhat by means of the lifting device, as a result of which the ballast water let in will gather near the lower end of the anchor and the anchor will likewise assume a vertical position.

It will be possible to ascertain fairly accurately:

at what depth the anchor will sink into the bottom, dependent on the properties of that bottom and on weight and dimensions of the anchor;

at what distance from the lower end the anchor cable 6 should be fastened so as to provide the maximum anchoring force; and to what extent this anchoring force may be increased without causing the anchor to be displaced.

According to the invention, the required ballast density for the anchor is dependent on the anchoring force to be provided, on the mechanical properties of the soil layer in or upon which the anchor is situated, as well as on the weight and dimensions of the anchor.

When the anchor is applied in a horizontal position according to FIG. 3, it may be useful, with bottoms having certain characteristics, for the bodies 1 and 2 to be supplied with projections 9 at their lower side for the purpose of increasing the friction force between the bottom and the anchor. These projections are shown in the drawing in FIGS. 2 and 3.

With both applications, the partition walls 3 need not be entirely closed.

It is possible, for instance, that the partition walls do not fully continue at the upper end as seen in a lying position of the anchor. In that case, too, it will be possible to realize an inclined or vertical position. Once the anchor is vertically afloat, the ballast water will remain at the bottom.

Besides, not fully closed partition walls have the advantage that it will not be necessary for all compartments to have their own ballasting connection 4. Also, ballasting with heavier materials, such as sand, gravel and fluid concrete, will be easier if these materials can flow from one compartment into the other.

Once the anchor has been placed upon or in the bottom, the partition walls no longer have a function.

I claim:

1. A method of placing a floatable anchor having a body with a closed hollow interior divided into compartments into the bottom of an ocean, river, lake, or other body of water, upon which a thick soft layer, such as mud, is present, comprising the steps of:

fastening one end of the body of the anchor to the lifting cable of a floating lifting device;

supplying sufficient water to a compartment of the body spaced from the attachment of the lifting cable of said lifting device so that the anchor assumes an upright position and the floating power of the anchor becomes negative, but not exceeding the required maximum lifting power of the lifting device;

paying out the lifting cable until the anchor reaches the bottom of the body of water and partly sinks therein; and ballasting the anchor while sinking, until the required anchor weight is obtained.

2. A method for placing a floatable anchor having a body with a closed hollow interior and a fastening point for an anchor cable, into the bottom of an ocean, river, or other body of water, upon which a thick soft layer, such as mud, is present, comprising the steps of:

fastening one end of the body of the anchor to the lifting cable of a floating lifting device;

lifting the end of the body attached to the cable with respect to the other end;

supplying so much water to the interior of the body that the anchor assumes an upright position and the floating power of the anchor becomes negative, but not exceeding the required maximum lifting power of the lifting device;

paying out the lifting cable until the anchor reaches the bottom of the body of water and sinks therein; and ballasting the anchor while sinking, until the required anchor weight is obtained.

3. A method according to claim 2, wherein the fastening point for the anchor cable is so placed that when the anchor is completely seated in the bottom of the body of water the fastening point is situated under the bottom surface of the body of water.

4. A method for placing an anchor having at least two bodies with hollow interiors on the bottom of an ocean, river, lake or other body of water, consisting of stiff layers or covered by a soft layer having relatively little depth, comprising the steps of:

fastening a lifting cable of a floating lifting device to both ends of one of the anchor bodies;

supplying so much water to the interior of the anchor that the floating power of the anchor becomes negative, but not exceeding the required maximum lifting power of the lifting device;

paying out the lifting cables until the anchor is lying on the bottom of the body of water; and further ballasting the anchor until the required anchor weight is obtained.

5. A method according to claim 4, wherein the lifting cable of the floating lifting device is fastened to both ends of only one body, the water is supplied to the other body until the floating power of the anchor becomes negative, but not exceeding the required maximum lifting power of the lifting device and the other body hangs lower than the one body, the lifting cables are eased off until the lower hanging body reaches the bottom; and further including the steps of at least partially ballasting both bodies, shifting the floating lifting device in a direction opposite to the direction of the floating structure to be moored so that the lifting cables make an angle with the vertical and the one body connected with the lifting cables is no longer perpendicularly above the other body and further ballasting the one body connected to the lifting cables while the lifting cables are further eased off until the anchor is lying flat on the bottom.

* * * * *